US006752178B1

(12) United States Patent
Jacobsson

(10) Patent No.: US 6,752,178 B1
(45) Date of Patent: Jun. 22, 2004

(54) METHOD FOR INSERTING AN ELASTOMERIC YARN AND YARN PROCESSING SYSTEM

(75) Inventor: Kurt Arne Gunnar Jacobsson, Ulricehamn (SE)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 10/221,431

(22) PCT Filed: Mar. 20, 2001

(86) PCT No.: PCT/EP01/03193

§ 371 (c)(1),
(2), (4) Date: Jan. 16, 2003

(87) PCT Pub. No.: WO01/71075

PCT Pub. Date: Sep. 27, 2001

(30) Foreign Application Priority Data

Mar. 20, 2000 (DE) ..... 100 13 776

(51) Int. Cl.[7] ..... D03D 47/34
(52) U.S. Cl. ..... 139/452
(58) Field of Search ..... 66/125 R, 132 R, 66/132 T, 146; 139/450, 452, 194, 453

(56) References Cited

U.S. PATENT DOCUMENTS

| | | | | | |
|---|---|---|---|---|---|
| 3,858,416 | A | * | 1/1975 | White et al. | 66/132 R |
| 3,911,698 | A | | 10/1975 | Walford | |
| 5,050,405 | A | | 9/1991 | Jacobsson | |
| 5,669,246 | A | * | 9/1997 | Massardi | 66/146 |
| 6,170,301 | B1 | * | 1/2001 | Stoll et al. | 66/126 R |

FOREIGN PATENT DOCUMENTS

| | | |
|---|---|---|
| DE | 3 335 875 | 4/1985 |
| EP | 0 744 483 | 11/1996 |

* cited by examiner

*Primary Examiner*—Danny Worrell
(74) *Attorney, Agent, or Firm*—Flynn, Thiel, Boutell & Tanis, P.C.

(57) ABSTRACT

A method for inserting a longitudinally elastic yarn from a yarn supply into a shuttleless weaving machine. The yarn is first removed with positive yarn feed from the yarn supply. Afterwards, the yarn in intermediately stored in adjacent windings with a predetermined elongation while using a winding speed that is synchronized with the positive feed speed, and for each insertion process, the yarn is released only with a predetermined insertion length.

21 Claims, 1 Drawing Sheet

METHOD FOR INSERTING AN ELASTOMERIC YARN AND YARN PROCESSING SYSTEM

FIELD OF THE INVENTION

This invention relates to a method for inserting an elastomeric yarn and a yarn processing system.

BACKGROUND OF THE INVENTION

A longitudinally elastomeric yarn may be processed in a knitting machine when the yarn is released from the yarn supply by a positive feeding device and is fed by the positive feeding device to the respective knitting system. In weaving machines and by weaving machine feeding devices until now only so-called covered elastomeric yarns of restricted longitudinal elasticity could be processed. Covered elastomeric yarns, however, show a stretching property with a stretching curve containing a "knee", meaning that the covering of the yarn physically increases the stretch force from the knee onwards. During each insertion process in the weaving machine the yarn first is stretched until the knee is reached, and then the yarn can be inserted at relatively stable relationships. Uncovered or bare elastomeric yarns, e.g. natural rubber yarns or elastomeric yarns, however, cannot be processed by weaving machine weft yarn feeding devices for feeding a weaving machine due to the extreme yarn stretchability. The preparation of covered elastomeric yarns by specific spinning processes, however, is costly.

It is an object of the invention to provide a method for inserting an elastomeric yarn into a weaving machine as well as a yarn processing system apt to carry out the method, both allowing the processing of longitudinally elastic elastomeric yarn material as the weft yarn of a weaving machine in a reliable way and independent from the yarn stretchability.

According to the method of the invention, the elastomeric yarn is supplied from the yarn supply to the shuttleless weaving machine such that the yarn first is released from the yarn supply by a positive yarn feeding process, then is intermediately stored in adjacent windings at a winding speed which is synchronised to the positive feeding speed and in a predetermined relation to the positive feeding speed and in a stretched condition, and finally is released for each insertion cycle with a predetermined insertion length. As by the synchronisation between the positive feeding speed and the winding speed for the intermediate storing process of the windings, a predetermined stretched yarn condition will be adjusted, which condition is independent from the stretchability of the yarn in the windings, and since the stretch will be controlled for each insertion cycle by measurement of the yarn release length, the yarn now can be processed by the weaving machine independent from the stretchability of the yarn. In this fashion, bare elastomeric yarn material can be processed for the first time in shuttleless weaving machines. Bare elastomeric yarns, however, can be produced for fair costs and offer an expanded degree of freedom of fabric elasticity in the weft yarn direction. The expanded degree of freedom is advantageous for stretched denim fabric (stretch jeans). An extremely stretchable bare elastomeric yarn does not need to be inserted by each pick into the fabric. A bare elastomeric yarn even may be inserted together with a normal yarn in one and the same pick, e.g. for producing a plated fabric.

The positive feeding device and the yarn intermediate storing and measuring feeding device are co-operating in the yarn processing system with each other such that a substantially uniform stretched yarn condition is maintained in the windings which are intermediately stored for intermittent consumption by the weaving machine. The stretched yarn condition may be precisely controlled by matching the speeds of the positive yarn feeding process and the winding on process. Furthermore, a desired stretch can be adjusted also in the weft yarn, because the weaving machine is inserting the yarn only in the form of precisely measured longitudinal sections and by one longitudinal section per pick. The stretch in the remaining intermittently stored windings cannot relax in the direction of the weaving machine. Only during the insertion cycle, the windings are not under form-fit control in the direction into the weaving machine. However, then the withdrawal force and the friction during withdrawal will cause an active hindrance which substantially suppresses a yarn relaxation acting rearwardly into the windings.

It is advantageous for the method to adjust the insertion length shorter than the weaving width of the weaving machine. This allows the adjustment of a predetermined stretched condition in the weft yarn in the fabric, e.g. about 300%. So to speak, the stretched condition of the weft yarn is frozen in the fabric by the closing action of the shed after the beat-up action.

Expediently, the magnitude of the yarn stretch in the intermediately stored windings can be maintained substantially constant by the measurement of the insertion length during the insertions or picks and also the resting periods between subsequent picks. This means that substantially no yarn length will be pulled back from the weaving machine while yarn fed by the positive feeding device is wound on. This is assured either by the stopping device carrying out the longitudinal measurement or by the withdrawal force during a simultaneously occurring pick. During an insertion only the predetermined and already stretched yarn length is released with which the weaving machine generates a predetermined stretch effect in the fabric. Even extremely stretchable yarn material can be correctly controlled by matching the proportions between the positive feeding speed and the winding on speed and by a phase equalisation (synchronisation). This means that the positive feeding device will start, stop, accelerate, and decelerate its motion as the winding on element does.

A positive feeding device is structurally simple and of reliable function, if it is operating with a driven conveying roller pressed against a rotatable yarn winding package or yarn bobbin. The drive of the conveying roller runs in synchronism with the winding drive and unreels the yarn. The positive feeding device can be mounted to the measuring feeding device and can be driven from the measuring feeding device, e.g. by a belt drive system or a gear transmission. The relation between the positive feeding speed and the winding on speed should be adjustable.

In the yarn intermediate storing and measuring feeding device the already stretched yarn is wound onto a stationary storage body in adjacent windings expediently with yarn separation, i.e., with axial intermediate distances between the adjacent windings. The yarn then will be held under stretch between the winding on element and the stop element. During each pick only the predetermined yarn length is released. Then the withdrawal force and the friction at the storage body will act in a yarn supporting way until the stop element again will support the remaining yarn windings against a relaxation. The stretched condition in the weft yarn in the fabric is adjusted then by releasing only a length which is defined in proportion to the weaving width. Particularly for processing bare elastomeric yarn material in a gripper weaving machine, it is expedient to provide a controlled yarn brake which, e.g. in the yarn transition phase between the bringer gripper and the taker gripper temporarily produces a predetermined braking effect in order to support the transition operation.

A monitoring assembly expediently is provided between the positive feeding device and the measuring feeding device. The monitoring assembly senses the yarn in a contactless fashion and does not generate significant additional friction for the yarn. In case of a yarn breakage or of an emptied yarn winding package or yarn bobbin, a stop signal is generated for the weaving machine.

BRIEF DESCRIPTION OF THE DRAWINGS

Embodiments of the object of the invention will be explained with the help of the drawings, in which.

DETAILED DESCRIPTION

Figure 1:
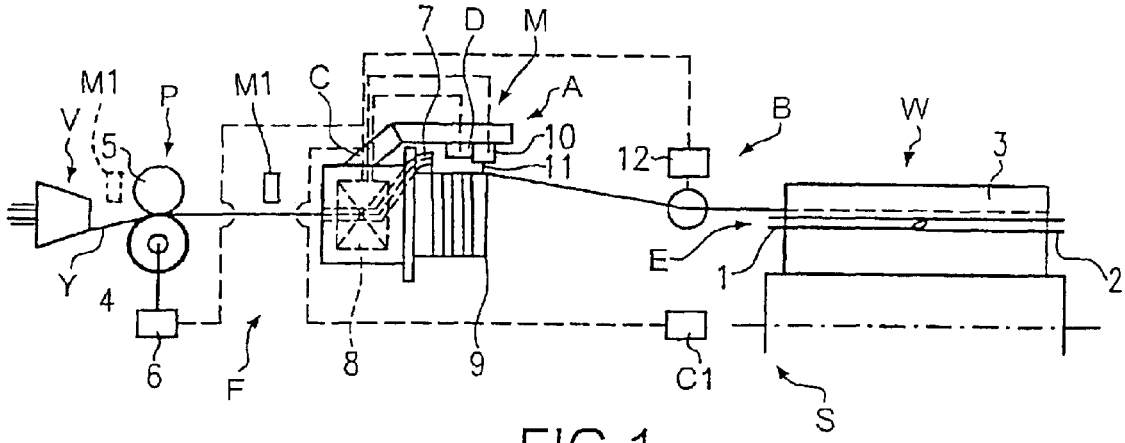
FIG. 1 is a schematic view of a yarn processing system for an elastomeric yarn.

A yarn processing system S shown in FIG. 1 comprises a yarn supply V of a longitudinally elastomeric yarn Y, a positive feeding device P, and downstream of the same a yarn intermediate storing and measuring feeding device M, both defining a yarn feeding device F. Optionally, a controlled yarn brake B is provided downstream of the device M. Furthermore, a shuttleless weaving machine W is provided as a yarn consuming textile machine, preferably a gripper weaving machine having a bringer gripper 1 and a taker gripper 2 which transfer the yarn Y to each other during an insertion substantially in the middle region of a shed 3. Both grippers 1, 2 form an insertion device E of the weaving machine W. Instead, the weaving machine W could be a projectile weaving machine.

The yarn Y is longitudinally elastic, e.g. is a bare elastomeric yarn of natural rubber or another elastomeric material. The positive feeding device P (only schematically indicated in FIG. 1) has a feeding roller 4 and a counter roller 5. The yarn Y may be wound e.g. once or several times around the feeding roller 4. Both rollers can be driven by a drive 6. Downstream or upstream of the positive feeding device P a monitoring assembly M1 (for detecting a yarn breakage or an empty supply) may be provided. A regulation parameter detecting device could co-operate with the drive 6 in order to either let the yarn Y be taken off from the yarn supply V or to feed the yarn to the measuring feeding device M with constant stretch, respectively. The detecting device is not shown.

The yarn intermediate storing and measuring feeding device M has a housing for a rotatable winding element 7 and for a stationary storage body 9. The winding element 7 is driven by an electric drive motor 8. The stationary storage body 9 serves to intermediately store the yarn Y in an intermediate supply in adjacent windings formed by the winding element 7. Expediently, the storage body 9 is equipped with not shown implements serving to create a yarn separation between the windings. The number of the yarn windings or the size of the intermediate supply, respectively, on the storage body 9 is surveyed by sensors D. The sensors D transmit signals to a control device C of the drive motor 8. Furthermore, a measuring device A is provided for measuring the yarn Y length which is released and taken off during each pick by the weaving machine W. The measuring device A, e.g., includes a stationary stop device 10 and a moveable stop element 11. The moveable stop element 11 is moveable into a stop position in cooperation with the storage body 9 and into a retracted release position. The storage body 9 can be designed with a variable diameter. The measuring device A can be connected to the control device C. The yarn brake B, e.g. a deflection brake, includes a drive 12 which, expediently, also is connected to the control device C. A control device Cl is associated with the weaving machine W, and is connected to the control device C. Also, the drive 6 of the positive feeding device P is connected to the control device C in order to adjust the positive feeding speed and the winding speed with equal phases and a predetermined relation between both. The relation should be variable.

The positive feeding device D is driven in proportion to and with the same phase (synchronously) as the winding element 7 of the measuring feeding device M. The drive motor 8 is accelerated, decelerated or stopped, e.g. depending upon signals emitted by the sensors D, in order to permanently and intermediately store a number of windings on the storage body 9 which number permanently suffices to cover a momentary or even an expected upcoming yarn consumption of the weaving machine W. To start an insertion cycle or pick a signal is transmitted from the control device C1 to the control device C (or directly to the stopping device 10) to move the stop element 11 from the stop position into the release position. The number of windings withdrawn during the insertion cycle or pick is registered, e.g. by a not shown withdrawal sensor. In order to release the adjusted insertion length of the yarn only, the stop element 11 is moved back into the stop position sufficiently early, e.g. via the control device C. The yarn brake B e.g. is controlled by the control device C, in order to brake the yarn during the transition phase during which the bringer gripper 1 transfers the tip of the yarn Y to the taker gripper 2.

The functioning of the system produces a stretch condition in the yarn Y in the intermediately stored windings on the storage body 9. This stretch condition is maintained essentially constant between the winding element 7 and the stop element 11 engaged in the stop position by adjusting the insertion length released for each insertion cycle in relation to the weaving width of the weaving machine W. Furthermore, the stretch of the yarn Y in the shed 3 is increased or decreased in relation to the stretch of the yarn Y in the intermediately stored windings.

Figure 2:
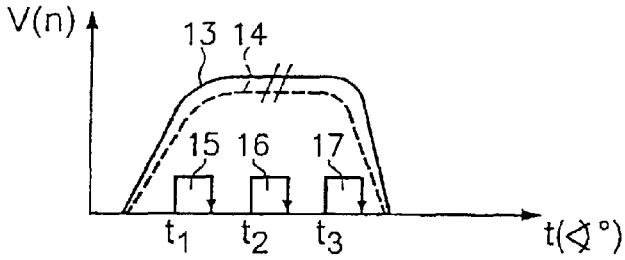
FIG. 2 is a speed-time-or rotation angle-time diagram.

The diagram of FIG. 2 shows how the drive motor 8 is accelerated from stand still, is brought to high speed, and finally is decelerated again to stand still following a curve 13. The dotted line curve 14 indicates the proportional lower speed of the positive feeding device P. At points in time t1, t2, t3 picks or insertion cycles are carried out, e.g. depending from the weaving pattern. At the respective point in time, the stop element 11 is moved from the stop position into the release position and, subsequently, i.e. before the released insertion length is reached, again is returned into the stop position. Expediently phase equity is adjusted, i.e. the positive feeding device D starts and stops at the same times as the winding element 7 does.

Figure 3:
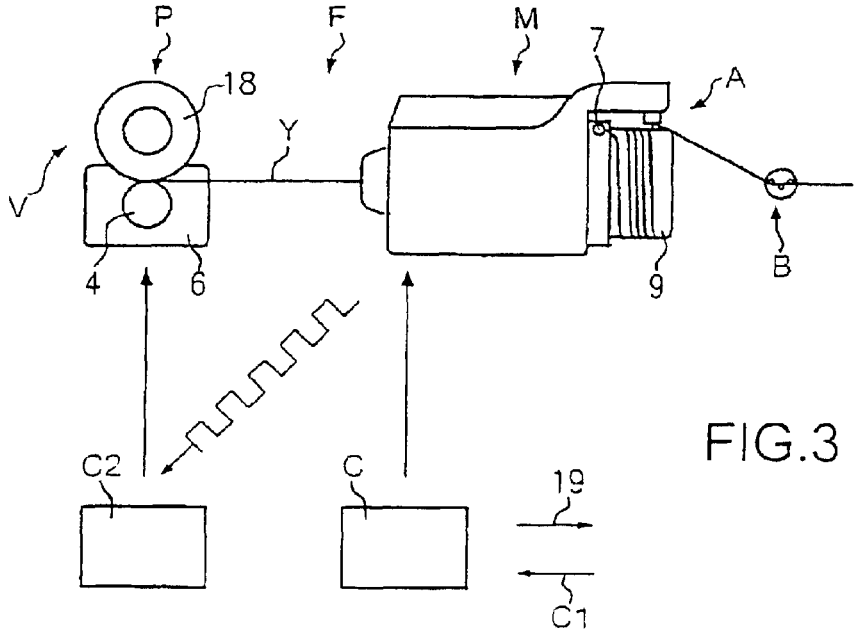
FIG. 3 is a yarn processing system according to FIG. 1, including modified details.

FIG. 3 shows an embodiment of a positive feeding device P at which the yarn supply V has a rotatable yarn winding package or yarn bobbin 18. The conveying roller 4 driven for rotation by drive 6, contacts the yarn package 18 and unreels the yarn Y. The drive 6 is connected to a control device C2 of the positive feeding device P which control device C receives control signals from the drive motor or the control device C, respectively, of the measuring feeding device M. Reference number 19 indicates the transmission of a stop signal to the weaving machine (in case of a yarn breakage, a disturbance or in case of an emptied yarn package 18). The positive feeding device P could be mounted at the entrance side of the measuring feeding device M and could be driven from the same (with an adjustable speed relation).

The core of the invention is to additionally employ a yarn intermediate storing and measuring feeding device M for feeding elastomeric yarn material with a controlled stretch condition into a gripper weaving machine or a projectile weaving machine. The device M conventionally is only used in jet weaving machines, the insertion device of which is unable to define the respectively pulled-off yarn length by itself. The insertion device of a gripper weaving machine or a projectile weaving machine, by nature, automatically carries out the yarn length measurement for each insertion cycle. Despite the automatic length measurement present in such weaving machine types, the measuring feeding device M is used intentionally in order to control the stretched condition of the elastomeric yarn while it is inserted in the weaving machine. The measuring feeding device also is used here, because it is impossible to feed such elastomeric yarns to the weaving machine solely by using a positive feeding device, as the positive feeding device is unable to cope with the strong accelerations and decelerations of the intermittent operation of the weaving machine. The positive feeding device, however, is used to supply the elastomeric yarn to the measuring feeding device already with an adjustable stretch condition. The length measuring device maintains the stretch condition in the intermediately stored windings and adjusts a predetermined yarn stretch condition also in the fabric, namely by co-operation with the automatic length measuring insertion device of this type of a weaving machine. The method and the yarn processing system, according to the invention, respectively, are particularly useful for weaving uncovered elastomeric weft yarns of extreme stretchability. As the employed positive feeding device P, particularly the ELAN-feeder, produced by the company Memminger-IRO GmbH, DE, has proven to operate excellently.

What is claimed is:

1. Method for inserting a longitudinally elastic yarn from a yarn supply into a shuttleless weaving machine, according to which method the yarn first is unreeled by positive yarn feed operation from the yarn supply and subsequently is intermediately stored in adjacent windings with a predetermined stretch condition and at a winding speed which is matched with the positive feeding speed, the intermediately stored yarn finally being released for each insertion cycle with a predetermined insertion length.

2. Method as in claim 1, wherein the respective released insertion length is set to be shorter than the weaving width of the weaving machine.

3. Method as in claim 1, wherein the positive feeding speed and the winding speed are matched synchronously with the same phase and with a predetermined relation.

4. Method as in claim 1, wherein the stretch condition in the wound on windings is adjusted by setting the relation between the positive feeding speed and the winding speed, and the stretch condition of the weft yarn in the fabric is adjusted by setting the relation between the insertion length and the weaving width.

5. Yarn processing system, including a yarn supply of longitudinally elastic yarn, a feeding device arranged downstream of the yarn supply, and a shuttleless weaving machine, said feeding device including a positive feeding device and a yarn intermediate storing and measuring feeding device arranged downstream of the positive feeding device, the positive feeding speed and the intermediate storing winding on speed are brought into a predetermined relation with one another with the help of driving assemblies of the positive feeding device and of the yarn intermediate storing and measuring feeding device.

6. Yarn processing system as in claim 5, wherein the positive feeding device comprises a driven conveying roller which is pressed against a rotatable yarn winding package.

7. Yarn processing system as in claim 5, wherein the yarn intermediate storing and measuring feeding device comprises a rotary driven winding element, a stationary storage body, and a stop device having a stop element which is moveable between a stop position wherein the stop element is positioned at the storage body and a lifted release position.

8. Yarn processing system as in claim 5, wherein a controlled brake is arranged downstream of the yarn intermediate storing and measuring feeding device, and the weaving machine comprises one of: a gripper weaving machine including bringer and taker grippers; and a projectile weaving machine.

9. Yarn processing system as in claim 5, wherein a yarn motion monitoring device is provided between the positive feeding device and the yarn intermediate storing and measuring feeding device.

10. Method as in claim 1, wherein the elastic yarn is inserted from the yarn supply into one of: a gripper weaving machine; and a projectile weaving machine.

11. Method as in claim 1, wherein the winding speed is proportionately matched with the positive feeding speed.

12. Method as in claim 1, wherein the winding speed is matched with the positive feeding speed such that the respective phases of the winding speed are synchronous with the respective phases of the positive feeding speed, and the winding speed and positive feeding speed are proportional to one another.

13. Method as in claim 12, wherein the winding speed is matched with the positive feeding speed such that the winding speed is proportionally greater than the positive feeding speed.

14. Method as in claim 1, wherein the winding speed is matched with the positive feeding speed such that the respective start and stop phases of the winding speed are synchronous with the respective start and stop phases of the positive feeding speed, and the winding speed and the positive feeding speed are proportional to one another.

15. Method as in claim 3, wherein the predetermined relation between the positive feeding speed and the winding speed is adjustable.

16. Yarn processing system as in claim 9, wherein the yarn motion monitoring device comprises an optical device for contactlessly sensing a yarn breakage or an empty yarn supply.

17. Yarn processing system as in claim 5, wherein the driving assemblies of the positive feeding device and the yarn intermediate storing and measuring feeding device respectively comprise first and second drives, the yarn intermediate storing and measuring feeding device including a stationary storage body, a winding element rotatably driven by the second drive to form a yarn store on the storage body, and the system includes a control connected to the first and second drives to adjust the predetermined relation between the positive feeding speed and the winding speed such that the start and stop phases of the winding speed are synchronous with the respective start and stop phases of the positive feeding speed, and such that the winding speed and the positive feeding speed are proportional to one another.

18. Yarn processing system as in claim 17, wherein the yarn intermediate storing and measuring feeding device includes a sensor disposed to monitor the size of the yarn store on the storage body and which transmits signals to the control to operate the winding element accordingly.

19. Yarn processing system as in claim 18, wherein the yarn intermediate storing and measuring feeding device includes a measuring device connected to the control and including a stop element which is movable between a stop position wherein the stop element cooperates with the storage body to stop the yarn and a retracted position to release the yarn, and a yarn brake disposed downstream of the stop element and connected to the control.

20. Yarn processing system as in claim 17, wherein the control is a first control and forms part of the intermediate storing and measuring feeding device to control the second drive, and the feeding device includes a second control which controls the first drive and communicates with the first control to adjust the predetermined relation between the positive feeding speed and the winding speed.

21. Method as in claim 15, wherein the winding speed is set to be proportionally higher than the positive feeding speed.

* * * * *